United States Patent [19]

Howard

[11] 4,051,553

[45] Oct. 4, 1977

[54] HAND PROTECTOR

[76] Inventor: Arthur R. Howard, 4705-29th St., Lubbock, Tex. 79410

[21] Appl. No.: 750,381

[22] Filed: Dec. 14, 1976

[51] Int. Cl.[2] ..... A41D 19/00

[52] U.S. Cl. ..... 2/161 A; 2/20

[58] Field of Search ..... 2/16, 20, 159, 161 R, 2/161 A, 168, 158

[56] References Cited

U.S. PATENT DOCUMENTS

| | | | |
|---|---|---|---|
| 203,959 | 5/1878 | Townsend | 2/161 R |
| 1,387,728 | 8/1921 | Kramer | 2/168 |
| 3,052,889 | 9/1962 | Furey | 2/161 A |
| 3,588,917 | 6/1971 | Antonious | 2/161 A |
| 3,626,515 | 12/1971 | Murray | 2/161 A X |
| 3,918,096 | 11/1975 | Lim | 2/161 A |
| 3,945,045 | 3/1976 | Rhee | 2/16 |
| 3,952,333 | 4/1976 | Fujita | 2/161 A |

*Primary Examiner*—G. V. Larkin
*Attorney, Agent, or Firm*—Wendell Coffee

[57] ABSTRACT

For football, a hard foam rubber pad is affixed to the back of a lightweight cotton glove. The pad extends over the knuckles, (metacarpo-phalangeal joint), of a hand inserted in the glove. The pad is molded so as to force the fingers to naturally curl without conscious effort, but allowing the fingers to be straightened with conscious effort. By curling the fingers, the probability that the fingers will be bent backward over the back of the hand with resultant injury is greatly reduced. The pad also protects the back of the hand from direct injury. In addition, latex rubber affixed to the fingers, thumb, and palm of the glove enables an athlete to grip a ball with greater facility.

11 Claims, 4 Drawing Figures

HAND PROTECTOR

BACKGROUND OF THE INVENTION

1. Field of the Invention

This invention relates to apparel for protecting hands, and more particularly to apparel for protecting hands during sports activities.

2. Description of the Prior Art

Before my invention, hand protective devices for athletics merely covered the hand with padding to prevent injury from direct contact with the back of the hand, i.e., falling, bruising, and striking.

Also, before my invention, some hand protective devices purported to cause the fingers to curl to assist in a gripping function by means of webbing material to keep the fingers from straightening. However, these devices do not allow the fingers to be straightened.

Further, before my invention gloves were available with gripping material affixed to the thumb and fingers of the glove to assist in gripping wet, slippery surfaces.

The following are examples of prior art devices known to me before filing this patent application:

Burden, U.S. Pat. No. 1,796,319,
Lewis, U.S. Pat. No. 2,567,498,
Applegate Jr. et al, U.S. Pat. No. 3,307,209,
Thomas, U.S. Pat. No. 3,066,306,
Bruchas, U.S. Pat. No. 3,096,523,
Stanton, U.S. Pat. No. 3,597,765,
Diggins, U.S. Pat. No. 3,890,649.

SUMMARY OF THE INVENTION

1. New and Different Function

I have invented an athletic glove for football that protects the hand and fingers and facilitates ball handling. By combining a feature which enhances the gripping ability of the wearer with a feature which protects the back of the hand and causes the fingers to curl naturally, but allows the fingers to be straightened with conscious effort, I have provided the ideal protective glove for football and other contact sports. By curling the fingers, the probability that the fingers will be bent backward over the back of the hand with resultant injury is greatly reduced.

This combination of singular features accomplishes a greater purpose than each feature independently accomplished by providing complete protection for the hand and fingers while at the same time allowing the flexibility necessary to use in sports activities.

2. Objects of this Invention

An object of this invention is to protect hands of athletes from direct injury.

Another object is to protect fingers from injury by being bent over the back of the hand.

Still another object of this invention is to facilitate ball handling in athletic endeavors.

Further objects are to achieve the above with a device that is sturdy, compact, durable, lightweight, simple, safe, efficient, versatile, ecologically compatible, and reliable, yet inexpensive and easy to manufacture and fit.

Other objects are to achieve the above with a method that is versatile, ecologically compatible, rapid, efficient, and inexpensive, and does not require skilled people to fit.

The specific nature of the invention, as well as other objects, uses, and advantages thereof, will clearly appear from the following description and from the accompanying drawing, the different views of which are not necessarily to the same scale.

DESCRIPTION OF THE PREFERRED EMBODIMENT

Glove 10 comprises the base structure to which the other features are attached. I prefer to use a glove made of lightweight cotton net fabric because of the superior washability, durability, and strength of such fabric.

Pad 12 is affixed within the glove 10 to the back thereof. The pad 12 is of such dimensions that the pad extends over the area of the metacarpo-phalangeal joints or knuckles "K" of a hand inserted in the glove 10. I prefer to use a pad composed of hard foam rubber ¼th inch (about 6.25 mm) thick which has been processed so that a "skin" covers the pad. Pad covering 14 is of the same material as that of the glove 10. Thus, it may be seen that the pad 12 is of a lightweight, resilient material. The pad 12 is snugly fitted within the covering 14.

Figure 2:
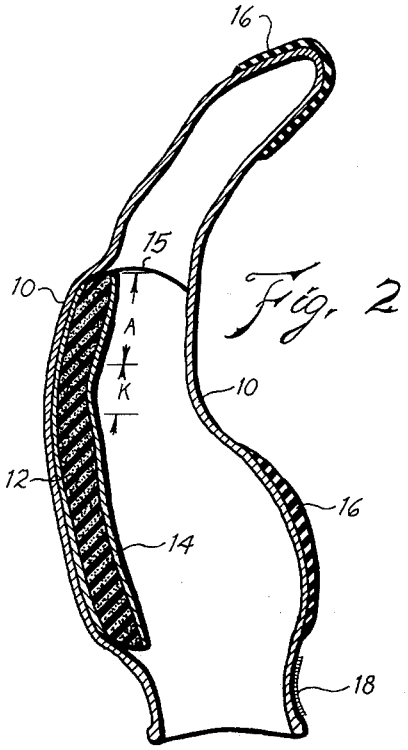
FIG. 2 is a longitudinal sectional view thereof.
Figure 3:
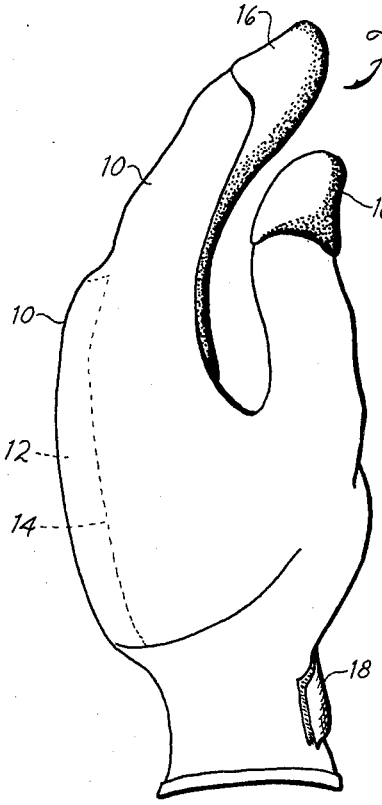
FIG. 3 is a side view thereof.

Referring to FIG. 2, the pad 12 is molded such that the part of the pad 12 that contacts the fingers of a hand is at an angle with the part of the pad that contacts the back of the hand. Therefore, pressure is exerted on the fingers at area "A" distally past the knuckles "K" from the back of the hand.

Figure 1:
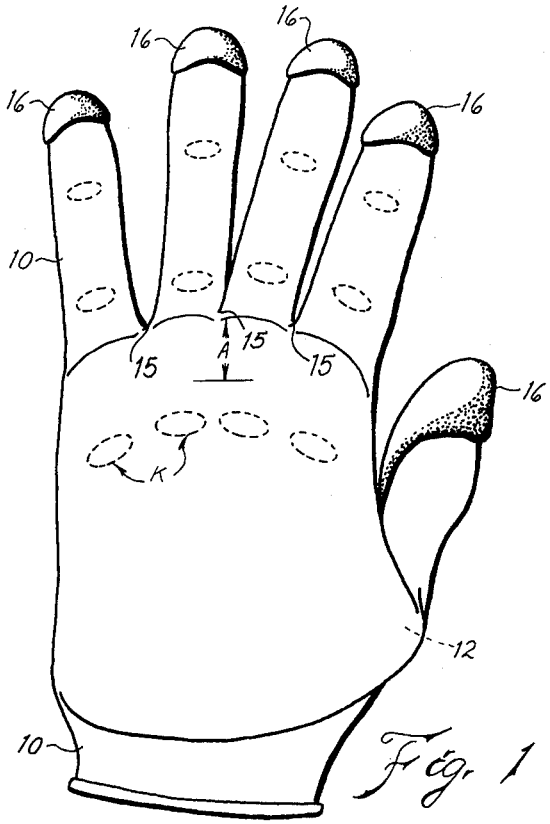
FIG. 1 is a back view of an embodiment of this invention.

Referring to FIG. 1, the pad 12 extends distally to webbing 15 between the fingers of a normal glove. Webbing is herein defined as the point at which the fingers of the glove or hand are joined together at the point where the fingers merge into the body of the glove or hand. Thus it may be seen that the webbing of a normal hand will be about the median distance between the metacarpo-phalangeal joint and the proximal phalangeal joint. "Median" as used herein is defined as "being in the middle; occupying an intermediate position". It is also common knowledge among those skilled in the art that normally webbing 15 of a glove does not fit snugly against the webbing of a hand inside the glove, and, therefore, will be distally past the webbing of a hand. It will be seen that by extending the pad to the webbing of the glove, I have insured that the area "A" of pad contact will be distally of the median of the first phalanx. This will be adequate for the purposes of this invention, i.e., to exert sufficient force on the fingers to cause them to curl.

Figure 4:
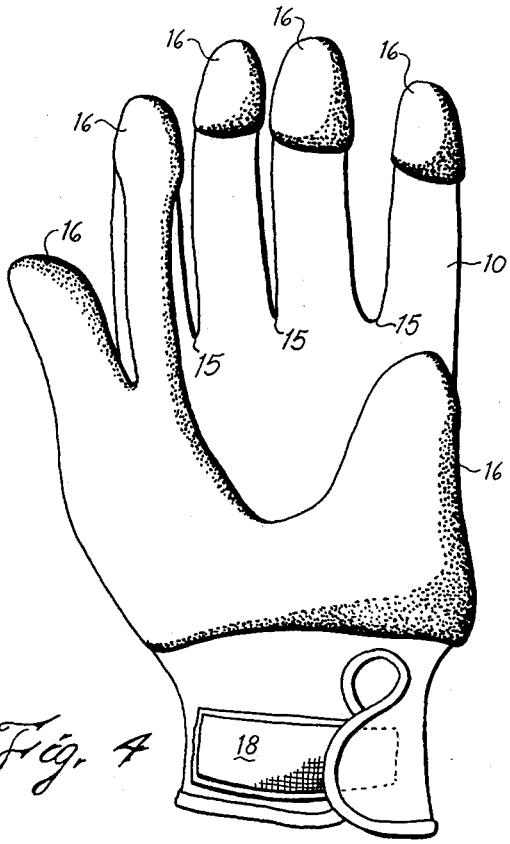
FIG. 4 is a palm view thereof.

Affixed to the fingertips, inside of the index finger and thumb, and the heel of the palm is friction material 16 as seen in FIG. 4. I prefer to use latex rubber compound for the friction material because of its durability and propensity to facilitate ball handling in sports activities, particularly football.

Fastener 18 is affixed to the wrist area of the glove 10. I prefer to employ "VELCRO" to comprise the fastener apparatus as opposed to buckles or snaps because of the ease of removal and lack of hard objects from a safety standpoint of such a fastener.

Thus, the glove may be rapidly donned and doffed during sporting activities.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. The hand protective device comprising:

a. a glove, b. a pad of resilient material attached to the back of said glove, c. said pad extends over the metacarpo-phalangeal joints of a hand inserted into said glove, d. said pad is molded such that it curves downward against the fingers at a point distal of the metacarpo-phalangeal joints of a hand inserted into said glove, e. said molded pad providing means for exerting a force on the top of the fingers of a hand inserted into said glove, f. said glove is made of cotton net, g. said resilient material comprises hard foam rubber, h. said pad is covered by cotton net, j. friction material is affixed to the palm surfaces of the length of the thumb and index finger, the palm, and the tips of the remaining fingers, k. said friction material is latex rubber compound, m. said glove is secured by a VELCRO tape fastener affixed to the wrist of the glove.

2. The invention as defined in claim 1 with an additional limitation of f. said pad extends distally beyond the median of the first phalanx of each finger.

3. The invention as defined in claim 2 with an additional limitation of g. said pad extends to the webbing between the fingers of said glove.

4. The invention as defined in claim 3 with an additional limitation of h. said molded pad covering the back of a hand inserted into said glove.

5. The invention as defined in claim 4 with additional limitations of j. said glove having friction material affixed to the inside surface of the thumb, fingers, or palm, or any combination thereof, and k. said friction material providing means for gripping footballs.

6. The invention as defined in claim 5 with additional limitations of m. the outside surface of the resilient material having a skin.

n. said skin providing means for protecting said resilient material from destruction.

7. The invention as defined in claim 6 with an additional limitation of u. the friction material is affixed to the palm surfaces as shown in FIG. 4.

8. A glove having a. a pad of resilient material attached to the back of said glove, b. said pad extends over the metacarpo-phalangeal joints of a hand inserted into said glove, c. said pad covers the back of a hand inserted into said glove, d. said pad extends distally beyond the metacarpo-phalangeal joints of the hand inserted within said glove but not beyond the proximal phalangeal joint of each finger, e. said pad is molded such that it curves downward against the fingers at a point distal of the metacarpo-phalangeal joints but not beyond the proximal phalangeal joints, f. said molded pad providing means for exerting a force on the top of the first phalanx of the fingers of a hand inserted into said glove.

9. The invention as defined in claim 8 with additional limitations of f. said glove having friction material affixed to the inside surface of the thumb, fingers, or palm, or any combination thereof, and g. said friction material providing means for gripping footballs.

10. The invention as defined in claim 8 with additional limitations of h. the outside surface of the resilient material having a skin, j. said skin providing means for protecting said resilient material from destruction.

11. The invention as defined in claim 8 with an additional limitation of f. said pad extends to the webbing between the fingers of said glove.

* * * * *